US006427506B1

(12) United States Patent
Prunbauer

(10) Patent No.: US 6,427,506 B1
(45) Date of Patent: Aug. 6, 2002

(54) FLAT-KEY LOCK

(75) Inventor: Kurt Prunbauer, Herzogenburg (AT)

(73) Assignee: EVVA-Werk Spezialerzeugung von Zylinder- und Sicherheitsschlossern Gesellschaft m.b.H. & Co. KG, Vienna (AT)

( * ) Notice: Subject to any disclaimer, the term of this patent is extended or adjusted under 35 U.S.C. 154(b) by 0 days.

(21) Appl. No.: 09/578,061

(22) Filed: May 24, 2000

(30) Foreign Application Priority Data

May 26, 1999 (AT) ..... 938/99

(51) Int. Cl.[7] ..... E05B 29/00

(52) U.S. Cl. ..... 70/495; 70/409; 70/493; 70/358; 70/395; 70/398; 70/375; 70/382; 70/420; 70/421

(58) Field of Search ..... 70/495, 409, 358, 70/493, 492, 395, 398, 360, 276, 419, 369, 407, 340, 421, 353, 354, 377, 406, 375, 382, 385, 420

(56) References Cited

U.S. PATENT DOCUMENTS 4,325,242 A * 4/1982 Tietz ..... 70/401
4,377,082 A * 3/1983 Wolter ..... 70/364 A
4,612,787 A * 9/1986 Prunbauer et al. ..... 70/358
4,825,672 A * 5/1989 Rabinow ..... 70/377
5,088,306 A * 2/1992 Field ..... 70/375
5,176,015 A * 1/1993 Sussina ..... 70/369
5,372,024 A * 12/1994 Riickert ..... 70/406

FOREIGN PATENT DOCUMENTS

EP 0 851 079 7/1998

* cited by examiner

*Primary Examiner*—William A. Cuchlinski, Jr.
*Assistant Examiner*—Ronnie Mancho
(74) *Attorney, Agent, or Firm*—Herbert Dubno; Andrew Wilford

(57) ABSTRACT

A lock has a flat key having a flat blade extending along a key axis and having an axially extending edge formed to each side of a central axially extending key plane with a pair of axially extending inner edge surfaces flanking the key plane and each formed with a plurality of bits offset transversely at different spacings from the key axis. The bits on one side of the key plane are offset axially to the bits on the other side of the key plane as described above. A barrel having an inner surface centered on a lock axis holds a plug rotatable about the lock axis in the barrel, bisected by a plug plane including the lock axis, and formed with an axially extending and open key hole adapted to receive the key with the axes coaxial and the planes coplanar. A respective set of axially spaced tumblers is dis-placeable in the plug to each side of the plug plane parallel to the plug plane. The tumblers of one of the sets engage the key in the hole at locations offset axially from the tumblers of the other set. Respective springs urge the tumblers radially out-ward.

13 Claims, 8 Drawing Sheets

FLAT-KEY LOCK

FIELD OF THE INVENTION

The present invention relates to a flat key and lock therefor. More particularly this invention concerns a high-security lock using a flat key.

BACKGROUND OF THE INVENTION

A standard flat-key lock has a cylinder or barrel in which a plug can rotate about an axis. The plug is formed with an axially extending hole to which the key is fitted. Tumblers are displaceable transversely of the axis between freeing positions blocking rotation of the plug in the barrel and locking positions permitting such rotation. The key has an edge formed with bits that engage the respective tumblers when it is fully inserted in the hole to set the tumblers in the freeing positions.

European 851,079 describes a key that engages split tumbler pins. The butting thus forms a sort of cam. In addition the rear edge of the key is provided on one side with a cam for additional tumblers. This combination of conventional tumbler pins and the additional tumbler is however disadvantageous since the number of possible codings is limited.

OBJECTS OF THE INVENTION

It is therefore an object of the present invention to provide an improved flat key and lock therefor.

Another object is the provision of such an improved flat key and lock therefor which overcomes the above-given disadvantages, that is which is of simple construction in that it is made of a small number of standard parts so that it can be made inexpensively yet which offers a large number of codings so that it is very secure against both picking and forcing.

SUMMARY OF THE INVENTION

A flat key has according to the invention a flat blade extending along an axis and having an axially extending edge formed to each side of a central axially extending key plane with a pair of axially extending inner edge surfaces flanking the key plane and each formed with a plurality of bits offset transversely at different spacings from the axis. The bits on one side of the key plane are offset axially to the bits on the other side of the key plane.

This system greatly increases the number of bits that are available, making the potential codings or combination vast. The offset makes a lock for this key still relatively short.

The key edge is formed according to the invention with a pair of outer edge surfaces flanking the inner edge surfaces and each formed with a plurality of bits offset transversely at different spacings from the axis. The bits of the outer edge surface on one side of the key plane are offset axially to the bits of the outer edge surface on the other side of the key plane. Furthermore blade can have a side face formed with a longitudinal actuating formation. In addition the key can be reversible when it has a second axially extending edge formed identically to the first-mentioned edge.

A lock has according to the invention a flat key having a flat blade extending along a key axis and having an axially extending edge formed to each side of a central axially extending key plane with a pair of axially extending inner edge surfaces flanking the key plane and each formed with a plurality of bits offset transversely at different spacings from the key axis. The bits on one side of the key plane are offset axially to the bits on the other side of the key plane as described above. A barrel having an inner surface centered on a lock axis holds a plug rotatable about the lock axis in the barrel, bisected by a plug plane including the lock axis, and formed with an axially extending and open key hole adapted to receive the key with the axes coaxial and the planes coplanar. A respective set of axially spaced tumblers is displaceable in the plug to each side of the plug plane parallel to the plug plane. The tumblers of one of the sets engage the key in the hole at locations offset axially from the tumblers of the other sets. Respective springs urge the tumblers radially outward.

The inner edge surface is formed to each side of the plug with a radially inwardly directed retaining notch and each tumbler is formed with a radially outwardly directed retaining notch. The lock further has according to the invention respective retaining elements in the plug to each side of the plug plane and each having an outer end engageable in the respective inner-surface retaining notch and inner bus engageable in the notches of the tumblers on the respective side of the plug plane. Each of the retaining elements is an axially elongated bar and each of the respective grooves is axially elongated. Springs urge the retaining elements radially outward.

The retaining-element outer ends are both offset to the same side of a secondary plane through the lock axis and transverse to the plug plane. The grooves are similarly offset so that the elements can only both fit in the respective grooves in a predetermined angular position of the plug in the barrel. The key can only be withdrawn when the tumblers are clear of the retaining elements since these tumblers must move parallel to the key plane as the key is inserted or withdrawn. In a system with two such radially outwardly directed retaining notches there are two positions in which the key can be withdrawn.

The tumblers in accordance with the invention on one side of the plane are offset to the tumblers on the other side of the plane by a distance equal to about 25% of an axial spacing between adjacent tumblers on the same side of the plane.

The key edge can also be formed with a pair of outer edge surfaces flanking the inner edge surfaces and each formed with a plurality of bits offset transversely at different spacings from the axis. The bits of the outer edge surface on one side of the plane are also offset axially to the bits of the outer edge surface on the other side of the plane. The tumblers have key-engaging bumps some of which are relatively long and engage the respective inner edge surface and the others of which are short and engage the respective outer edge surface. At least one of the long bumps is undercut or J-shaped so as to pass the respective outer edge surface.

The plug according to the invention is formed with respective guides in which the tumblers are displaceable and immediately adjacent each guide and parallel thereto with respective spring bores holding the respective tumbler springs, each tumbler having a protecting extending laterally into the respective spring bore. The guides are of rectangular section.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
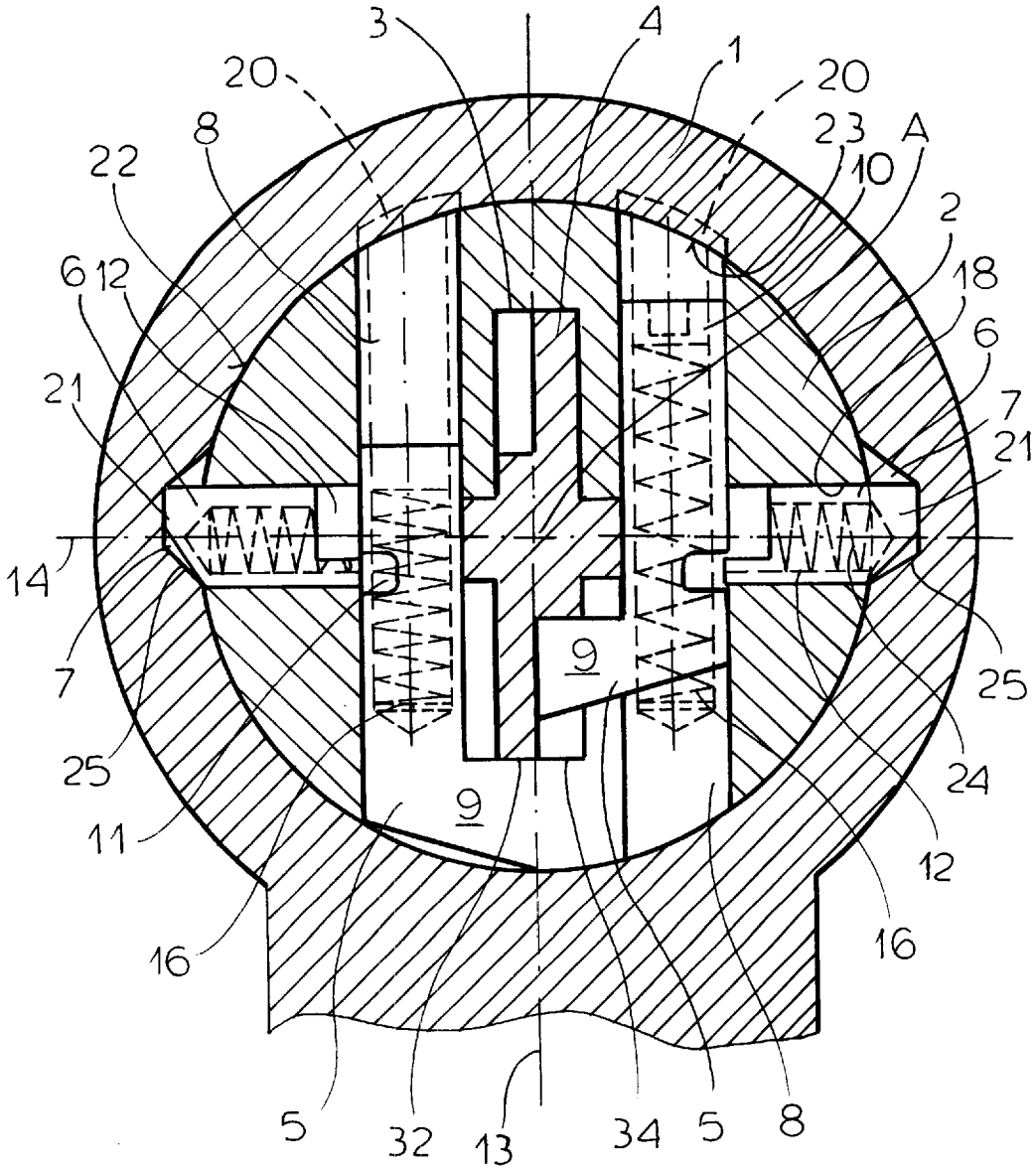
FIGS. 1 and 2 show the lock and key according to the invention in two different positions.
Figure 2:
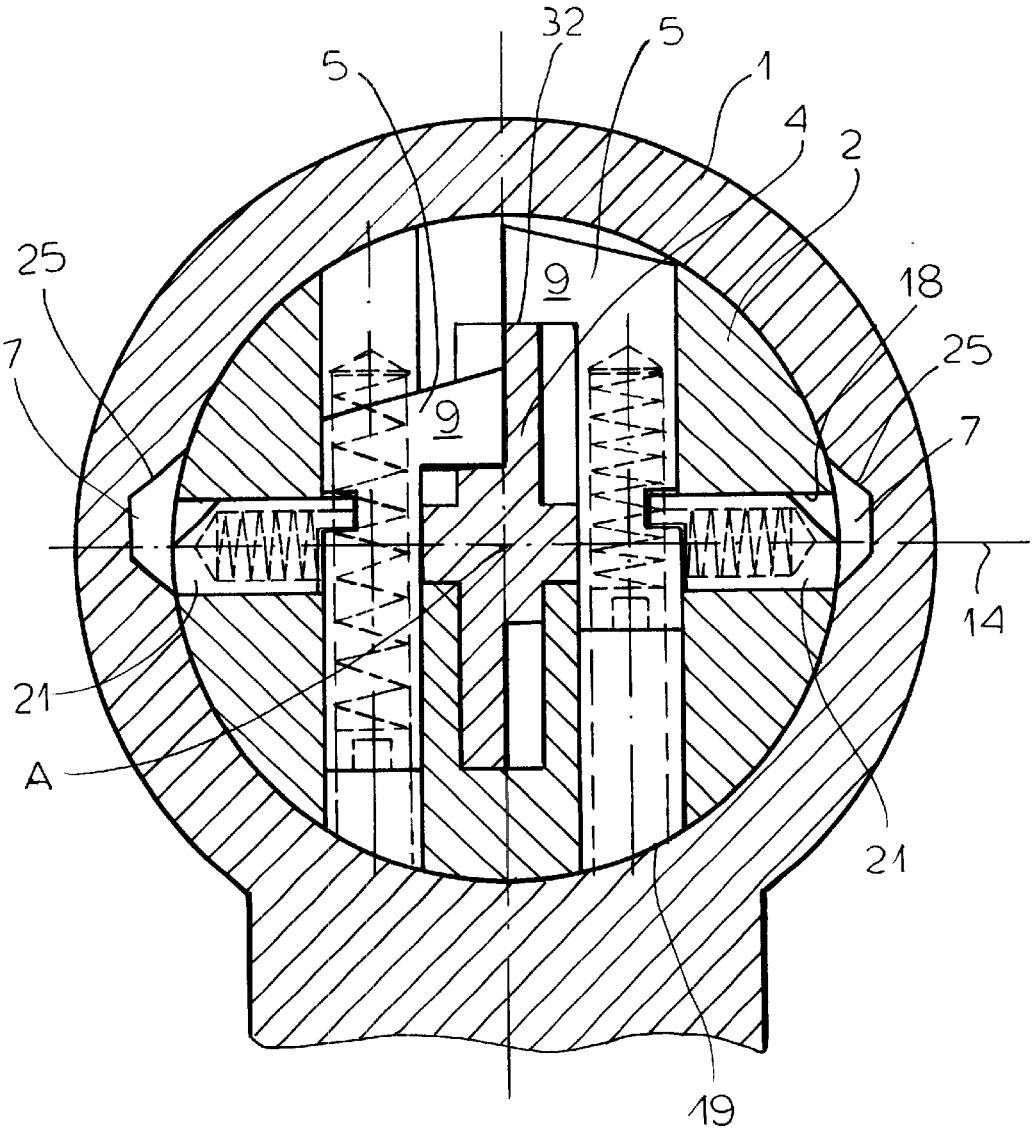

As seen in FIGS. 1 and 2 a lock according to the invention has a cylinder or barrel 1 centered on a plug axis A. A core or plug 2 can rotate about the plug axis A in the barrel 1 and has a cylindrical outer surface 22 riding on a cylindrical inner surface 23 of the barrel 1. The plug 2 is symmetrical to a lock plane 13 and a secondary plane 14 extends perpendicular thereto at the axis A. This plug 2 is formed with a rectangular-section central axially extending key hole 3 in which is fitted a flat key 4 bisected by the plane 13 when thus inserted.

Figure 6:
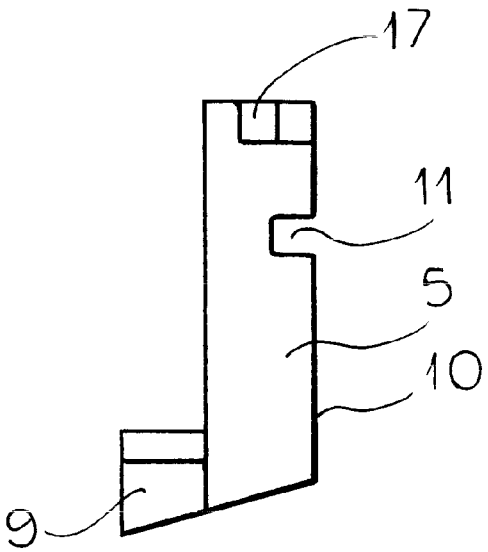
FIGS. 4, 5, and 6 are different side views of one of the tumblers of the lock.
Figure 5:
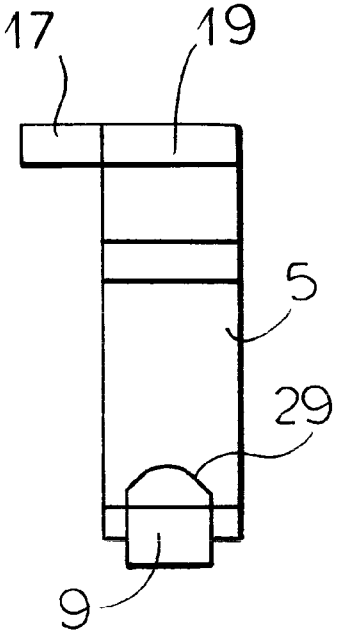
Figure 4:
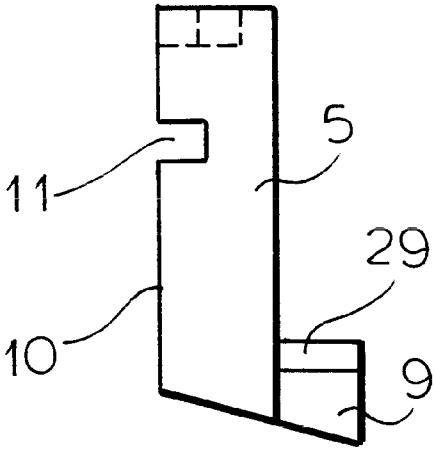

On each side of the plug plane 13 the plug 2 carries a set of five tumblers 5 (see also FIGS. 4 to 6) that each have a formation or bump 9 projecting transversely of the plane 13 toward the key hole 3 and an opposite edge 10 having a formation, here a notch 11, whose function will be described below. The bumps 9 are shaped as saddles or fitted with wear-reducing overlays 29. The end of each tumbler 5 opposite the bump 9 is provided with a laterally projecting tab 17 that is engaged by one end of a respective tumbler spring 16 whose opposite end is braced in the plug 2 so outer ends 19 of the tumblers 5 are biased outward against the surface 23. As is standard this surface 23 is formed with pockets 20 into which the tumblers 5 can engage to lock the plug 2 in the barrel 1.

Figure 3:
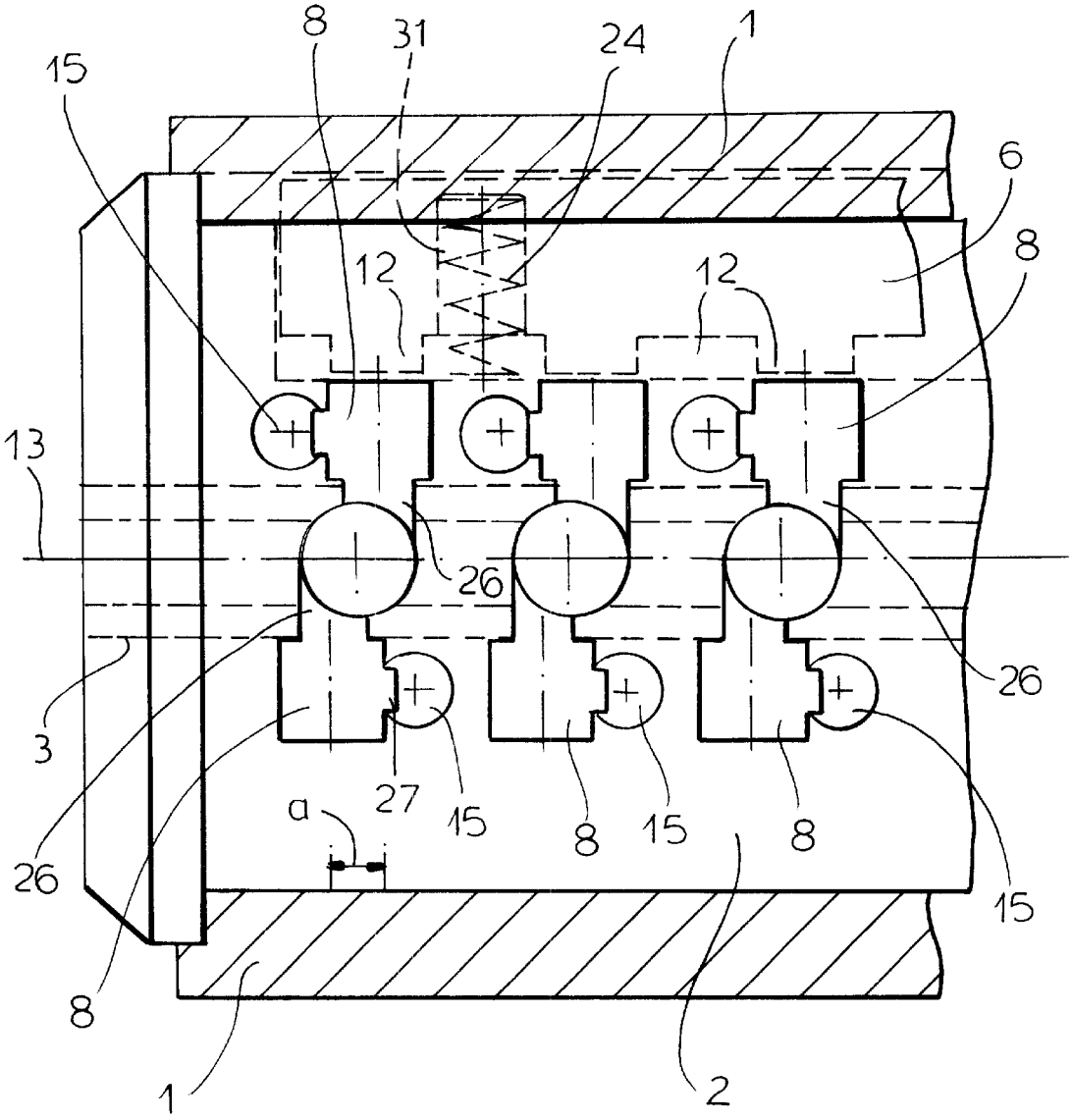
FIG. 3 is a top view partly in section through the lock.

The plug 2 is formed as shown in FIG. 3 with a square-section guide passage 8 for each tumbler and a cylindrical guide passage 15 for each spring 16, the passages 8 and 15 extending parallel to each others perpendicular to the axis A, and parallel to the plane 13. The passages 8 open via slots 26 into the key hole 3 and the passages 15 via slots 27 into the guides 8, the bumps 9 projecting through the slots 26 into the hole 3 and the tabs 17 projecting through the slots 26 into the holes 15. As shown in FIGS. 1 and 2, the formations 9 extend virtually to the plane 13. The key 4 has bitted axially extending surfaces 32 and 34 on which the inner edges 29 of the bumps 9 ride.

FIG. 3 shows how the tumblers 5 and the associated passages 8 and 15 with the springs 16 are offset from one side of the plane 13 to the other side by a distance a equal to about one-quarter of the axial spacing between adjacent tumblers 5. This offset greatly increases the codings that can be imparted to the key 4 in that one edge of the key 4 has, in effect, two sets of bittings. This offset further makes it possible to shorten the overall lock length by the distance a as compared to a similar double-tumbler lock.

To each side of the plane 13 the plug 2 is formed with a guide slot 18 centered on the perpendicular plane 14 and holding a respective key-retaining element 6 that is urged radially outward by a plurality of springs 24 (FIG. 3) engaged in seats 31 formed in the elements 6. Each such element 6 has on its inner edge five formations, here bumps 12, that are engageable in a direction perpendicular to the plane 13 in the notches 11 of the outer edges 10 of the tumblers 5. Furthermore each element 6 has an outer edge 21 engageable in a respective radially inwardly open and axially extending groove 7 formed in the inner surface 23 of the barrel 1. The radial dimension of each element 6 is such that its inner end 12 must engage in one of the notches 11 in order for its outer end 21 to pull out of the groove 6 and move inward past the surface 22. These two grooves 7 are offset somewhat from the plane 14 and the outer edges 21 are similarly offset so that only in a standard starting position shown in FIG. 1 can the elements 6 push radially out into the grooves; in a 180° inverted position shown in FIG. 2 they cannot fit.

Figure 9:
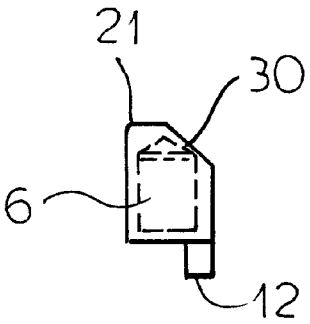
FIGS. 7, 8, and 9 are top, side, and end views of the latch element of the invention.
Figure 7:
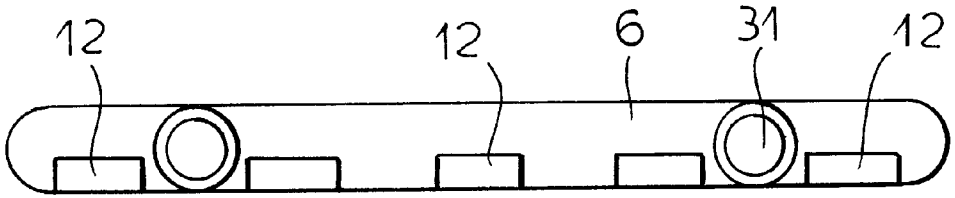
Figure 8:
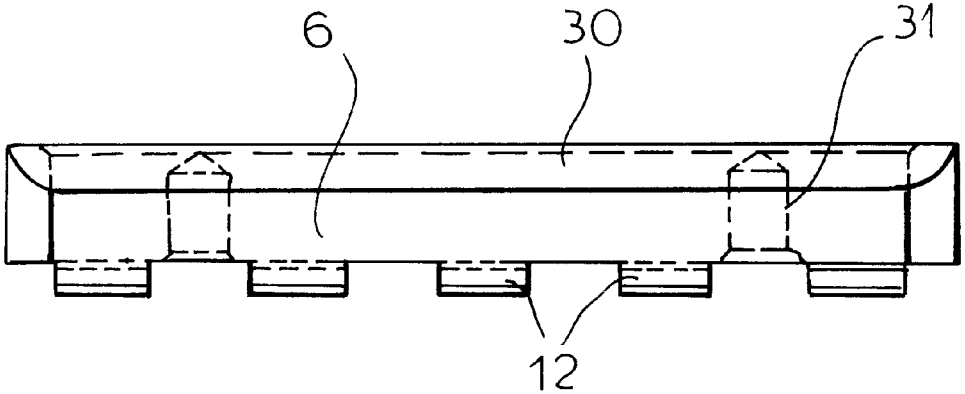

Thus the key 4 cannot be withdrawn from the lock except in the starting position since when the bumps 12 are engaged in the notches 11 the tumblers 5 cannot move and will therefore retain the key 4 in the hole 3. Similarly the elements 6 can only move inward into their releasing positions shown in FIG. 2 when all of the tumblers 5 on the respective side of the plane are pushed into positions by the bits of the edges 32 and 34 that align the notches 11 with the bumps 12. The grooves 7 have beveled flanks 25 and the outer end 21 has a beveled side 30 (FIGS. 8 and 9) that allow the elements 6 to be cammed in and slide gently out as the plug 2 is turned by the appropriately bitted key 4. It is possible to form a second notch 11 in each of the tumblers 5 as shown at 11' to allow key withdrawal in an alternate position.

As described in Austrian patent document A 965/96 it is possible to form each of the elements 6 of two parallel bars urged apart by one or more springs. One of the bars is formed with the edge 21 and the other with the bumps 12. In the blocking position the bump-carrying bar cannot move radially inward and blocks further rotation of the plug 2. Thus the functions of detecting and latching are separated.

Figure 10:
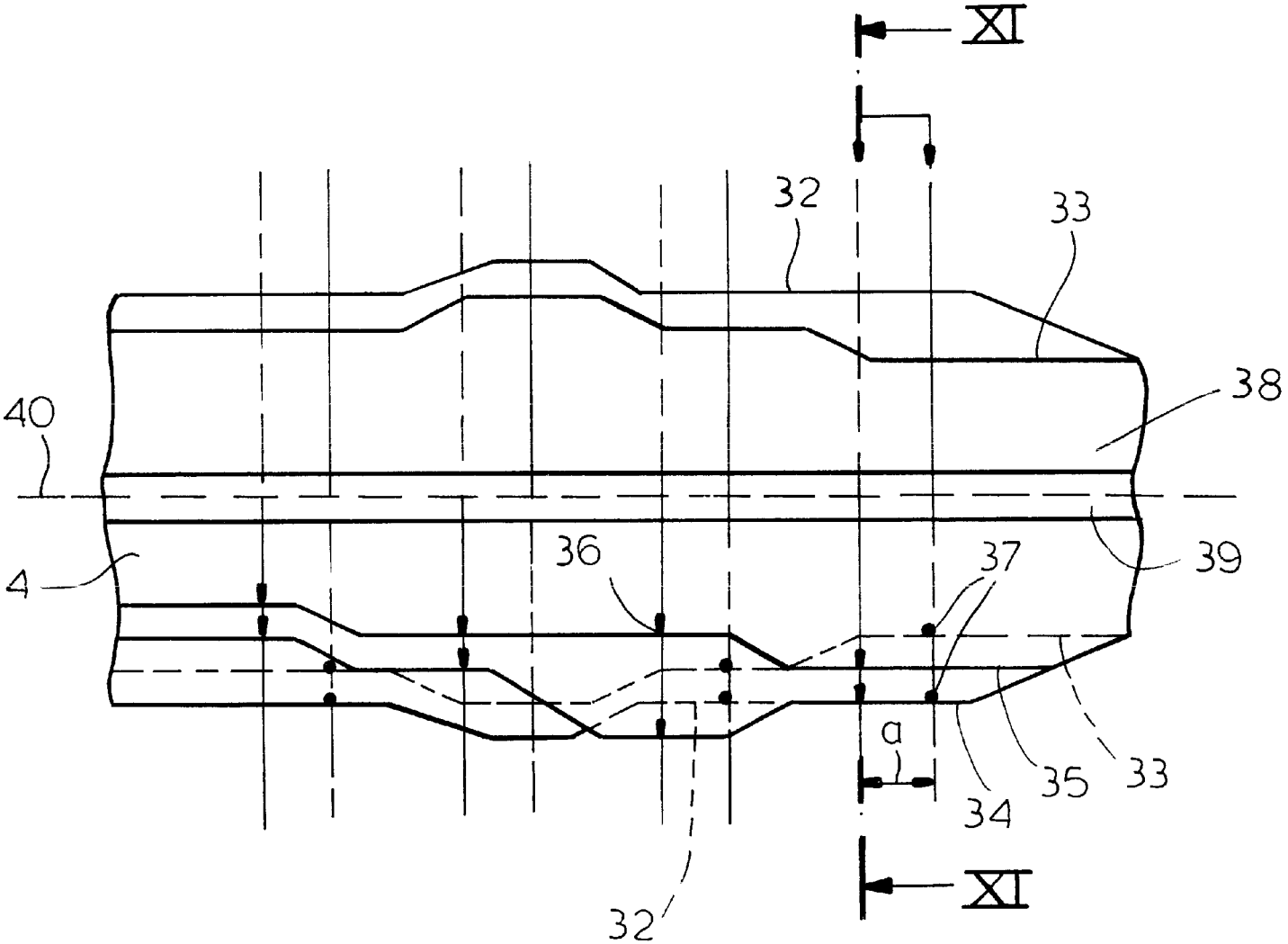
FIG. 10 is a large-scale side view of an end of a key according to the invention.
Figure 11:
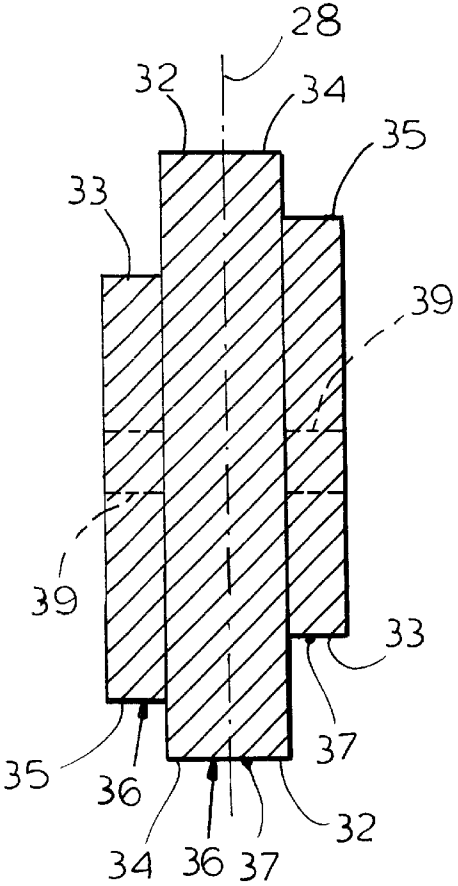
FIG. 11 is a section taken along line XI—XI of FIG. 10.

The key 4 shown in FIGS. 10 and 11 has a blade 38 and is formed along each of its opposite edges with, in addition to the two center bitted surfaces 32 and 34, two outer bitted surfaces 33 and 35 also flanking a symmetry plane 28 of the key 4 which lies on the plane 13 when the key is in the hole 3. The surfaces 34 and 35 to one side of the plane 28 each define four contact points 36 and the surfaces 32 and 33 to the opposite side four other contact points 37 that are equispaced. The points 36 are offset axially from the points 37 by a distance a which is equal to the offset from one side to the other of the tumblers 5. In addition each side face of the key 4 extending parallel to the symmetry plane 28 is formed with a longitudinal groove 39 that can function as described in my Pat. Nos. 4,977,767 and 5,797,287.

Figure 13:
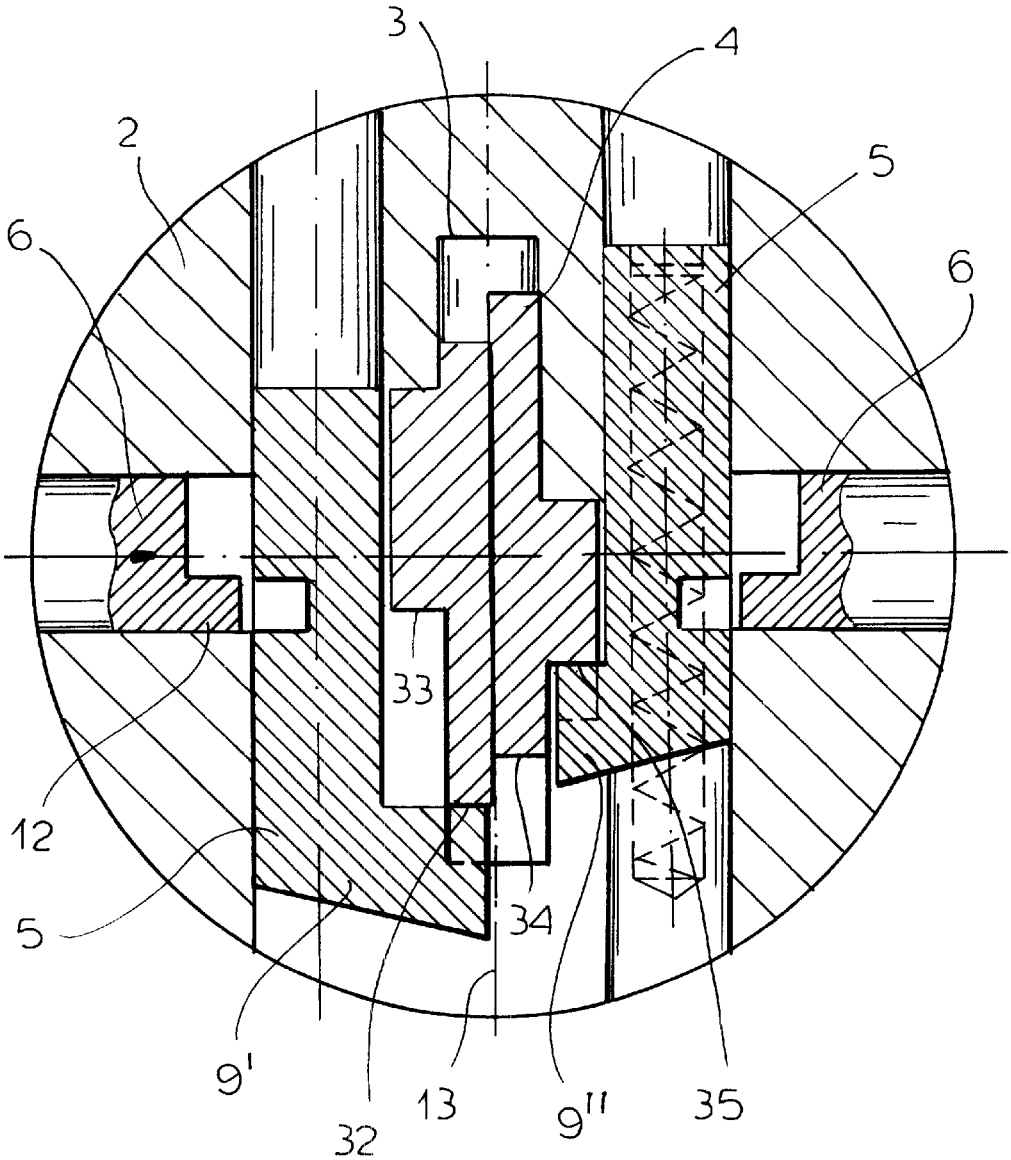
FIG. 13 is a cross section through another lock and key according to the invention that use the coding of FIG. 12.

FIG. 13 shows how the tumblers 5 can have bumps 9' and 9" of different lengths. Thus the tall bumps 9' engage the inner tracks or surfaces 32 and 34 while the short bumps 9' engage the outer tracks or surfaces 33 and 36. The key 4 is metrical to a central plane 40 so that it is reversible, that is the user need not worry about which side of the key is directed upward when inserting it. Of course one edge of the key could be straight and provided with secondary formations as described in my commonly owned above-cited patents.

Figure 14:
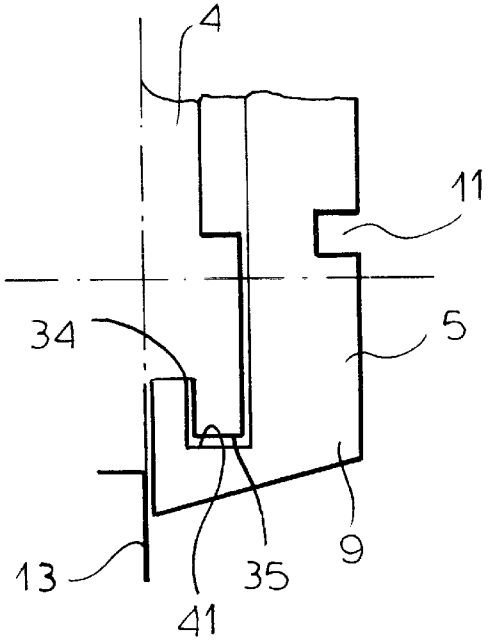
FIG. 14 is a large-scale view of a detail of FIG. 13.
Figure 12:
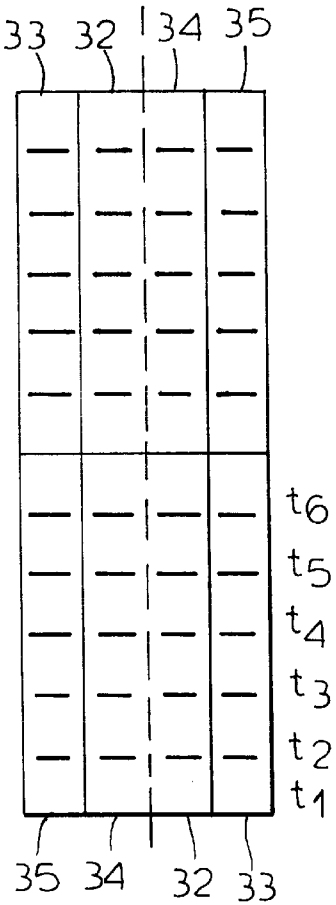
FIG. 12 is a diagram illustrating the coding of another key in accordance with the invention.

With this system as shown in FIG. 12 it is possible to achieve an enormous number of different codings by cutting each of the surfaces to a depth $t_1$, $t_2$, $t_3$, $t_4$, $t_5$,or $t_6$, FIG. 14 further shows how the bump can be undercut at 41 to accommodate a taller outer track 35. The user of combinations is therefore very great, here four bitted edges each having four bits each in turn capable of assuming one of six different heights.

I claim:

1. A reversible flat key comprising a flat blade extending along an axis and having a pair of identical axially extending edges each formed to each side of a central axially extending key plane with a pair of axially extending inner edge surfaces flanking the key plane and each formed with a plurality of bits offset transversely at different spacings from the axis, the bits on one side of the key plane of each edge being offset axially to the bits on the other side of the key plane of the respective edge.

2. The flat key defined in claim 1 wherein the edges are each formed with a pair of outer edge surfaces flanking the inner edge surfaces and each formed with a plurality of bits offset transversely at different spacings from the axis, the bits of the outer edge surfaces on one side of the key plane being offset axially to the bits of the outer edge surfaces of the respective edge on the other side of the key plane.

3. The flat key defined in claim 2 wherein the blade has a side face formed with a longitudinal actuating formation.

4. A lock comprising:

a reversible flat key comprising a flat blade extending along an axis and having a pair of identical axially extending edges each formed to each side of a central axially extending key plane with a pair of axially extending inner edge surfaces flanking the key plane and each formed with a plurality of bits offset transversely at different spacings from the axis, the bits on one side of the key plane of each edge being offset axially to the bits on the other side of the key plane of the respective edge;

a barrel having an inner surface centered on a lock axis;

a plug rotatable about the lock axis in the barrel, bisected by a plug plane including the lock axis, and formed with an axially extending and open key hole adapted to receive the key with the axes coaxial and the planes coplanar;

respective pairs of sets of axially spaced tumblers displaceable in the plug along each edge to each side of the plug plane parallel to the plug plane, the tumblers of one of the sets of each pair engaging the key in the hole at locations offset axially from the tumblers of the other set of the respective pair; and respective springs urging the tumblers radially outward.

5. The lock defined in claim 4 wherein the inner edge surface is formed to each side of the plug with a radially inwardly directed retaining notch and each tumbler is formed with a radially outwardly directed retaining notch, the lock further comprising:

respective retaining elements in the plug to each side of the plug plane and each having an outer end engageable in the respective inner-surface retaining notch and inner bumps engageable in the notches of the tumblers on the respective side of the plug plane.

6. The lock defined in claim 5 wherein each of the retaining elements is an axially elongated bar, the lock further comprising springs urging the retaining elements radially outward.

7. The lock defined in claim 6 wherein the retaining-element outer ends are both offset to the same side of a secondary plane through the lock axis and transverse to the plug plane.

8. The lock defined in claim 5 wherein each tumbler is formed with two such radially outwardly directed retaining notches.

9. The lock defined in claim 4 wherein the tumblers on one side of the plane are offset to the tumblers on the other side of the plane by a distance equal to about 25% of an axial spacing between adjacent tumblers on the same side of the plane.

10. The lock defined in claim 4 wherein the edge is formed with a pair of outer edge surfaces flanking the inner edge surfaces and each formed with a plurality of bits offset transversely at different spacings from the axis, the bits of the outer edge surface on one side of the plane being offset axially to the bits of the outer edge surface on the other side of the plane, the tumblers having key-engaging bumps, some of the bumps being relatively long and engaging the respective inner edge surface and the other bumps being short and engaging the respective outer edge surface.

11. The lock defined in claim 10 wherein at least one of the long bumps is undercut so as to pass the respective outer edge surface.

12. The lock defined in claim 4 wherein the plug is formed with respective guides in which the tumblers are displaceable and immediately adjacent each guide and parallel thereto with respective spring bores holding the respective tumbler springs, each tumbler having a projecting extending laterally into the respective spring bore.

13. The lock defined in claim 12 wherein the guides are of rectangular section.

* * * * *